US006045669A

United States Patent [19]

Matsumoto et al.

[11] Patent Number: 6,045,669

[45] Date of Patent: Apr. 4, 2000

[54] STRUCTURE OF ELECTRIC CONTACT OF ELECTROLYTIC CELL

[75] Inventors: Shingo Matsumoto; Minoru Yamada, both of Ibaraki-ken, Japan

[73] Assignee: Nippon Mining & Metals Co., Ltd., Tokyo, Japan

[21] Appl. No.: 09/128,943

[22] Filed: Aug. 5, 1998

[51] Int. Cl.[7] ..... C25D 17/04

[52] U.S. Cl. ..... 204/297 R; 204/297 W; 204/224 R; 204/285; 204/287; 205/574; 205/575; 205/576

[58] Field of Search ..... 204/297 R, 297 W, 204/224 R, 285, 287, 279; 205/574, 575, 576

[56] References Cited

U.S. PATENT DOCUMENTS 3,821,097 6/1974 Ettel ..... 205/576

4,134,806 1/1979 De Nora et al. ..... 205/576

4,479,863 10/1984 Honey et al. ..... 204/297 R

*Primary Examiner*—Bruce F. Bell

*Attorney, Agent, or Firm*—Akin, Gump, Strauss, Hauer & Feld, L.L.P.

[57] ABSTRACT

The present invention provides a structure of an electric contact of an electrolytic cell, wherein an elongated conductive member is provided as a bus bar 10 on a wall of an electrolytic cell for feeding current to anodes 1 and cathodes 2 arranged in the electrolytic cell; the conductive member 10 forms a convex portion 12 in parallel with the longitudinal direction on the upper surface of an elongated plate member 11 forming a base; and at least the upper surface of the convex portion 12 is totally or partially gold plated 13 in the longitudinal direction.

17 Claims, 4 Drawing Sheets

STRUCTURE OF ELECTRIC CONTACT OF ELECTROLYTIC CELL

BACKGROUND OF THE INVENTION

The present invention relates generally to an electrolytic refining technique such as electrolytic copper refining. More particularly, the invention relates to a structure of an electric contact, for example, between an anode or a cathode and a bus bar (common conductor) or a side bus bar in an electrolytic cell used for electrolytic copper refining.

In the conventional art of, for example, electrolytic copper refining, anodes 1 comprising blister copper (99% Cu) and cathodes 2 serving as starting sheets are alternately arranged in parallel with each other as shown in FIG. 5 in a rectangular electrolytic cell.

A bus bar 10 is arranged on a wall of the electrolytic cell 100, and auricles 1A of prescribed anodes 1 prepared by casting blister copper and an end 3A of a crossbar (conducting rod) attached with prescribed cathodes 2 are arranged on the bus bar 10. A plurality of electrolytic cells 200 are usually arranged in parallel as shown in FIG. 6, and the anodes 1 and the cathodes 2 in the electrolytic cells are connected to a power source (+, −) by the current feeding method (Walker mode) as shown in FIG. 6.

It is known that, when carrying out electrolytic copper refining with the use of such an apparatus, the electrolytic efficiency decreases with the lapse of time. This is attributable to the fact that copper sulfate solution composing the electrolytic bath splashes to electric contact such as a space between the bus bar 10 and the electrode 1 (and the crossbar 3), resulting in precipitation of copper sulfate ($CuSO_4$) at the contacts, thus causing an increase in contact resistance between the bus bar and the electrode. Such copper sulfate ($CuSO_4$) adhering to the bus bar 10 or the like cannot be removed by simple water rinsing, requiring a polishing operation, this requiring much time and complicated operations for maintenance and management.

With a view to solving these problem, proposals have conventionally been made to adopt a special bus bar known as a wet bus bar in which a water-containing sponge is arranged on a bus bar, or to pass water through a hollow tubular bus bar, causing production of water drops on the bus bar surface to prevent formation of a copper sulfate ($CuSO_4$) film at the contact, thus inhibiting an increase in contact resistance between the bus bar and the electrode. These measures cannot however be sufficient.

BRIEF SUMMARY OF THE INVENTION

These problems are encountered, not only at the electric contact between the bus bar and the electrode, but also, for example, between a side bus bar arranged for electrically connecting the electrolytic cells and the connecting conductor, and further, at an electric contact between the side bus bar and the electrode.

The present invention has therefore an object to provide a structure of an electric contact of an electrolytic cell which inhibits an increase in contact resistance at electric contacts of the electrolytic cell and always permit highly efficient electrolytic refining.

Another object of the invention is to provide a structure of an electric contact of an electrolytic cell which permits easy elimination of substances such as copper sulfate ($CuSO_4$) produced at electric contacts of the electrolytic cell, and facilitates maintenance and management of the electric contacts.

The above-mentioned objects of the invention are achieved by using the structure of an electric contact of an electrolytic cell of the invention. In summary, in the structure of an electric contact of an electrolytic cell of the invention, an elongated conductive member is provided as a bus bar on a wall of an electrolytic cell for feeding current to anodes and cathodes arranged in the electrolytic cell; the conductive member forms a convex portion in parallel with the longitudinal direction on the upper surface of an elongated plate member forming a base; and at least the upper surface of the convex portion is totally or partially gold-plated in the longitudinal direction.

According to another aspect of the invention, there is provided a structure of an electric contact of an electrolytic cell, wherein side bus bars and connecting conductors for electrically connecting the individual bus bars are provided along the side wall of electrolytic cells for electrically connecting neighboring electrolytic cells; at electric contacts between the side bus bars and the connecting conductors, any of the contact surfaces of at least any one of them is gold-plated; and, the bus bars and the connecting conductors are secured.

According to a further aspect of the invention, there is provided a structure of an electric contact of an electrolytic cell, wherein a crossbar is provided for suspending an electrode arranged in the electrolytic cell therefrom and for electrically connecting a bus bar or a side bus bar and the electrode; and at least the ends of the crossbar which come into electrical contact with the bus bar or the side bus bar are gold-plated.

According to a still further aspect of the invention, there is provided a structure of an electric contact of an electrolytic cell, wherein a bus bar or a side bus bar is provided on a wall of an electrolytic cell for feeding current to anodes arranged in the electrolytic cell; and each of the anodes is gold-plated at least at a portion in electrical contact with the bus bar or the side bus bar.

According to the above-mentioned inventions thereof, it is possible to perform the gold plating after nickel primer plating.

According to a preferred embodiment of the invention, the electrolytic cell is one used for electrolytic copper refining.

DETAILED DESCRIPTION OF THE INVENTION

The structure of the electric contact of the invention will now be described further in detail with reference to the drawings.

Embodiment 1

Figure 1:
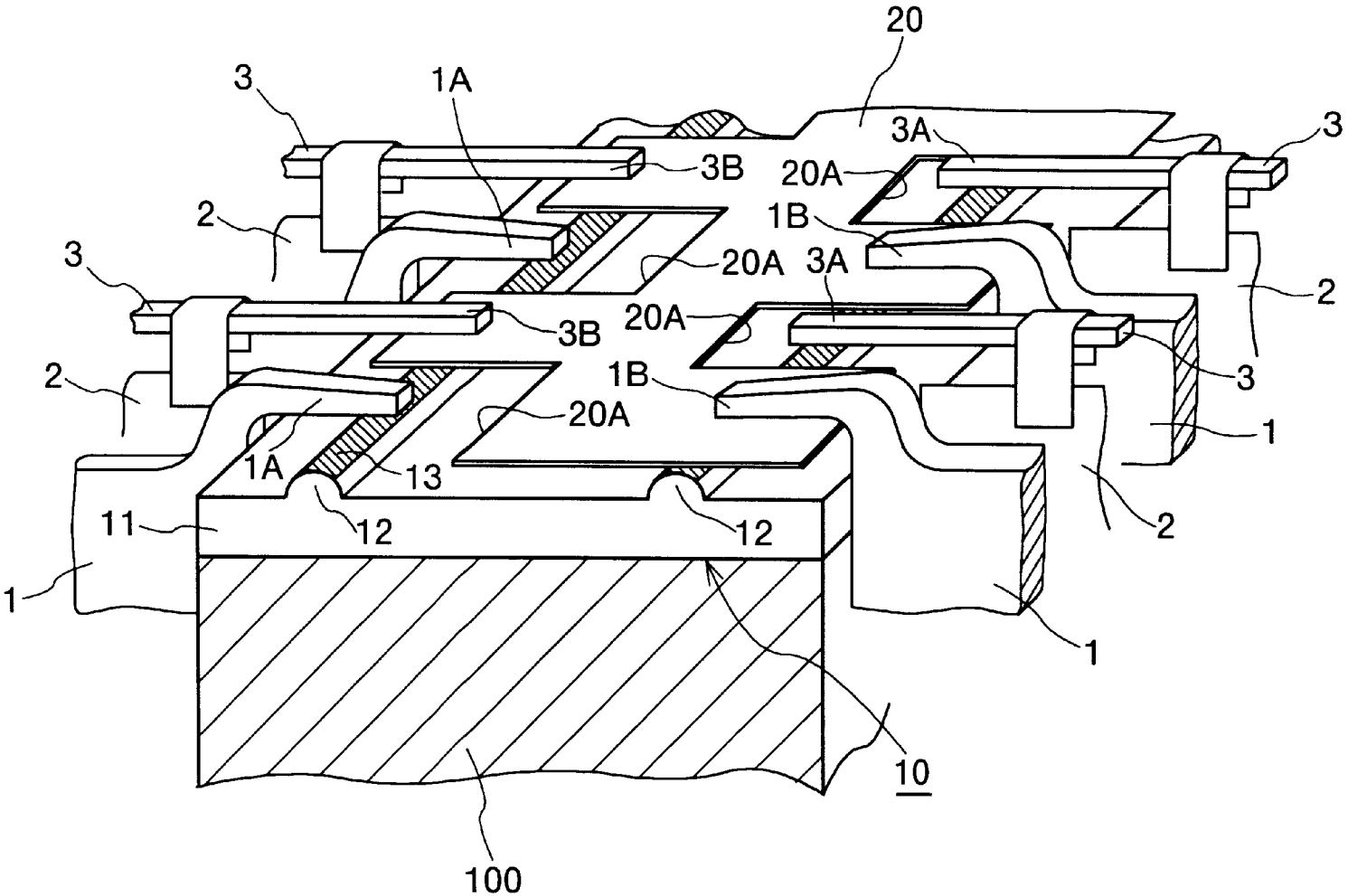
FIG. 1 illustrates a structure of a bus bar in an embodiment of the invention.

The present invention is applicable, as shown in FIG. 1, to a bus bar arranged on a long wall of an electrolytic cell, for example, in electrolytic copper refining.

More specifically, a bus bar 10 is arranged on a wall 100 of an electrolytic cell, and auricles 1A and 1B of an anode 1 prepared by casting blister copper and ends 3A and 3B of a crossbar (conducting rod) 3 attached with a cathode 2 are arranged on the bus bar 10.

Figure 2:
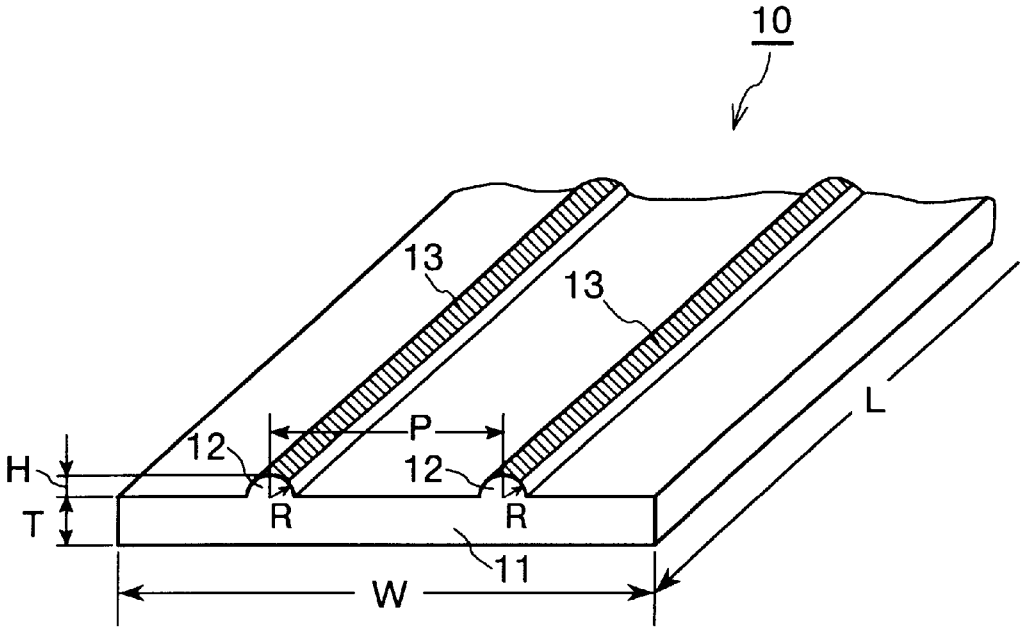
FIG. 2 illustrates an embodiment of the bus bar.
Figure 3:
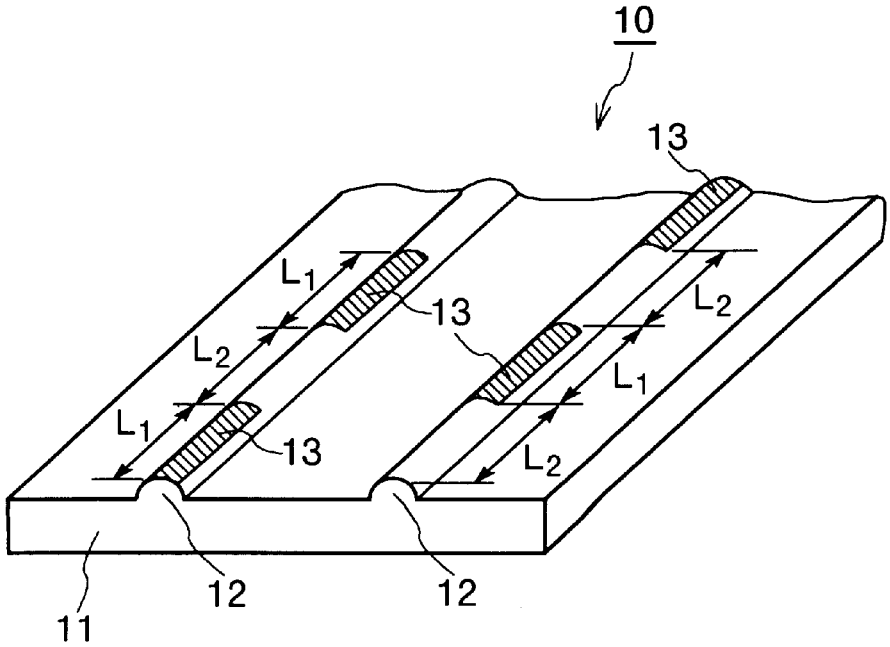
FIG. 3 illustrates another embodiment of the bus bar.

According to the invention, as shown in FIGS. 1 and 2, the bus bar 10 comprises a thin and long conductive member serving as a relay conductor arranged on the long wall 100 of the electrolytic cell. This conductive member comprises an elongated plate member 11 forming the base, and a convex portion 12 is formed in parallel with the longitudinal direction on the upper surface of the elongated plate member 11. The convex portion 12, of which details will be described later, is in direct contact with the auricle 1A of the anode 1 and the end 3A of the crossbar 3 attached with the cathode 2, and carries these components including the electrode. The convex portion 12 may be manufactured by integrally forming with the elongated plate member 11, or may be separately manufactured and secured integrally to the elongated plate member 11. The convex portion 12 should preferably have a convex curved surface as shown in FIGS. 1 and 2. The shape thereof is not limited to this, but the upper surface of the convex portion 12 may be flat, and any of various other shapes may be selected.

According to the invention, furthermore, at least the top surface of the convex portion 12, i.e., the surface portions in direct contact with the auricle 1A of the anode 1 and the end 3A of the crossbar 3 are plated with gold (Au) 13. It is needless to mention that gold may be plated 13 on a nickel plate applied as a primary coating.

In this embodiment, the plate-shaped conductive member 10 serving as the bus bar is made of copper, and the portion of the elongated plate member 11 forming the base has dimensions of 1.5 cm thick (T)×13 cm wide (W)×570 cm long (L).

The convex portion 12 is formed into a curved shape having a radium R=0.5 cm, and has a height (H) from the substrate 11 of 0.5 cm. Two convex portions 12 are formed P=10 cm apart from each other, and a portion of about 5 mm from the center of each convex portion toward the circumference on the side is gold-plated 13. The gold plating film 13, if with a thickness of about 1.3 $\mu$m, leads to production of pinholes in the plating film. According to the results of research and experiments carried out by the present inventors, a durability of about a year requires a thickness of about 5 $\mu$m, taking account of the wear.

When actually using the above-mentioned bus bar 10 of the invention, an electric insulating plate 20 having alternate notches 20A, for example as shown in FIG. 1, such as a ceramic plate is arranged on the bus bar 10, i.e., on the convex portions formed in parallel with each other. Therefore, while the auricle 1A of the anode 1 and the end 3 A of the crossbar 3 located on the notches 20A are in electric contact with the bus bar 10, an electric contact is not achieved for the auricle 1B of the anode 1 and the end 3B of the crossbar 3 with the bus bar 10 at the portion where the insulating plate 20 is located.

According to another embodiment of the invention, therefore, the gold plating 13 of the convex portion 12 can be applied only to the region ($L_1$) of the electric insulating plate 20 where the notches 20A are located. In other words, the region $L_1$ should preferably be as short as possible on the upper surface of each convex portion 12, and gold-plated and non-plated portions can be formed at intervals, for example, of $L_1 \leqq 5$ cm.

The bus bar 10 of the invention having the above-mentioned configuration was actually applied: deposition of a copper sulfate ($CuSO_4$) film onto the gold-plated surface of the convex portion of the bus bar 10 was inhibited, and contact resistance could be reduced from 20 mV observed in the conventional art to 5 mV, at 500 A. Although slight in amount, the copper sulfate ($CuSO_4$) film adhering to the gold-plated surface could be easily removed by water rinsing, thus permitting very easy maintenance of the apparatus.

Embodiment 2

Figure 4:
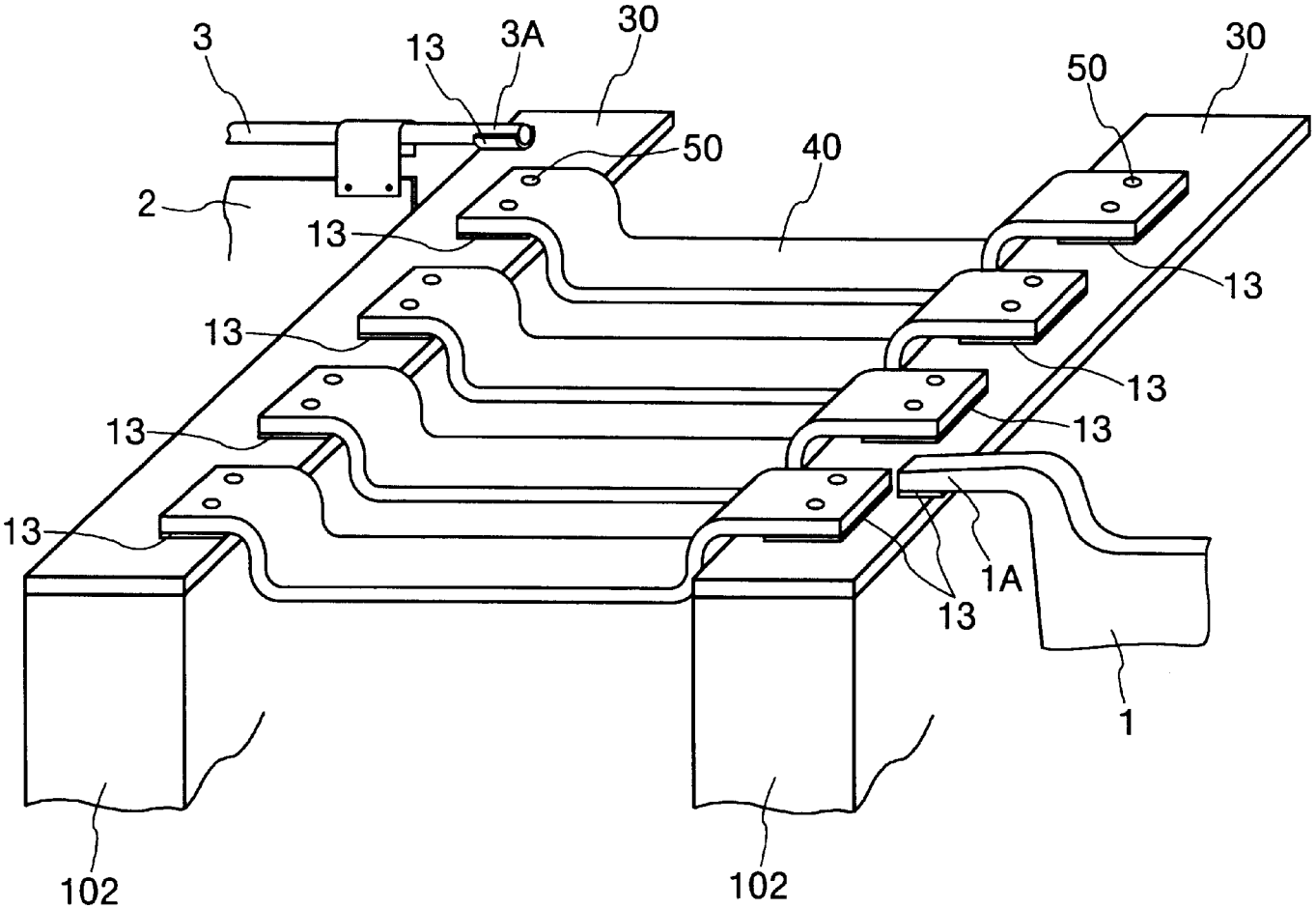
FIG. 4 illustrates a structure of a side bus bar and a connecting conductor in another embodiment of the invention.
Figure 5:
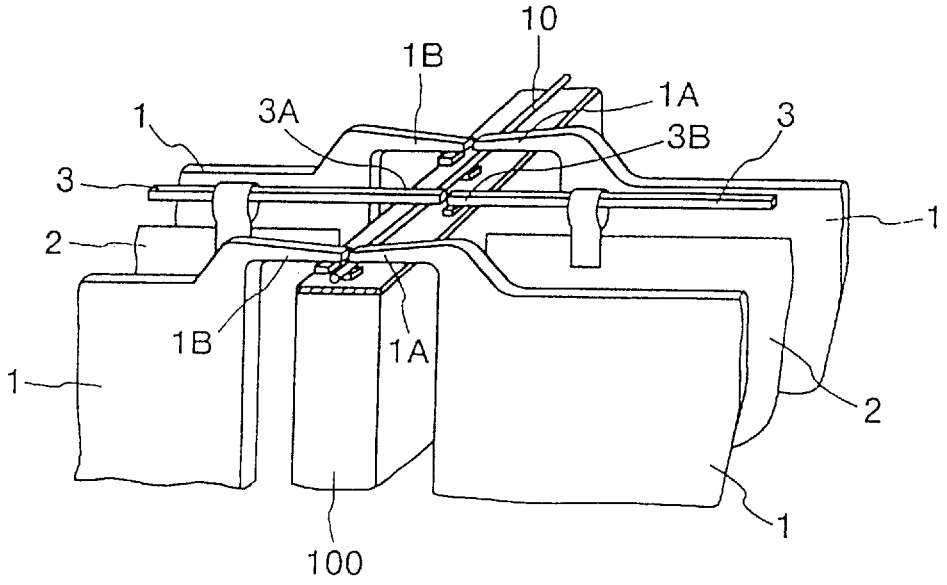
FIG. 5 PRIOR ART
FIG. 5 illustrates a structure of a conventional bus bar.
Figure 6:
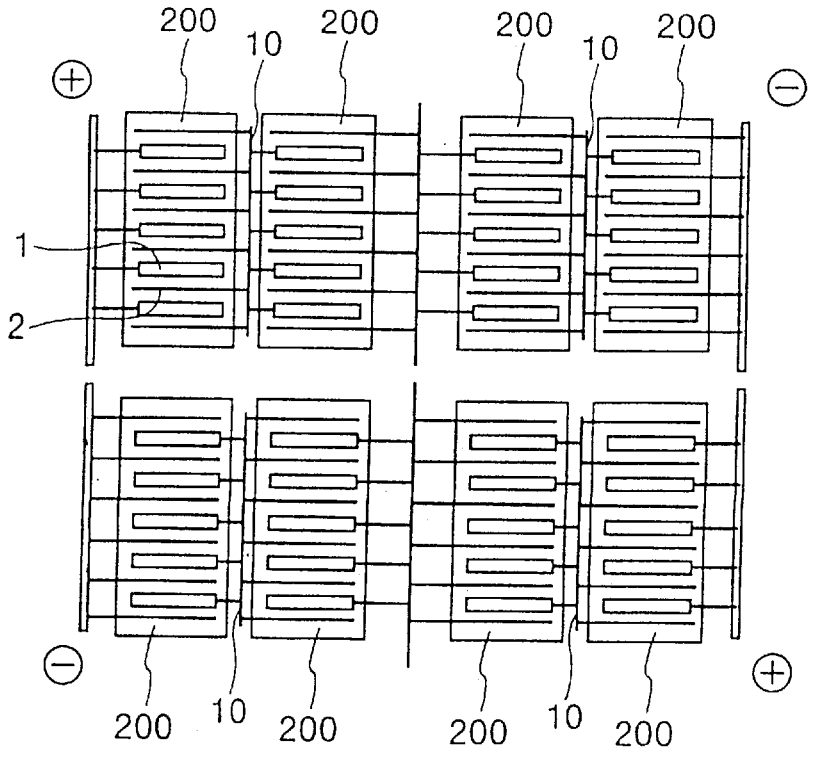
FIG. 6 PRIOR ART
FIG. 6 illustrates an arrangement of electrolytic cells for electrolytic copper refining and a current feeding mode between the electrolytic cells, to which the invention is applicable.

In electrolytic copper refining, for example, a plurality of electrolytic cells are provided in parallel with each other. In this case, as shown in FIG. 4, it is the conventional practice to connect side bus bars 30 arranged along the cell walls 102 provided in the cells with connecting conductors 40. The side bus bars 30 and the connecting conductors 40 have conventionally been secured by soldering. A problem was that the electric contacts were easily susceptible to corrosion, thus increasing contact resistance, and requiring frequent maintenance and management of these contacts.

According to the invention, at least any of the electric contacts between the side bus bars 30 and the connecting conductors 40 is gold-plated 13, and thereafter, the side bus bars 30 and the connecting conductors 40 are secured with tightening means 50 such as bolts and nuts. The results of research and experiments carried out by the present inventors reveal that a thickness of the gold plating 13 of about 5 $\mu$m is sufficient.

The above-mentioned configuration prevents corrosion of the electric contacts between the side bus bars 30 and the connecting conductors 40, inhibits an increase in contact resistance, and as a result, eliminates the necessity of maintenance and management of the connecting portions. The copper sulfate ($CuSO_4$) film and the like adhering to the gold-plated portion 13 can be easily removed by water rinsing, this providing another advantage of easy maintenance of the apparatus.

Embodiment 3

In electrolytic copper refining, as described above, the cathode 2 is suspended from the crossbar (conducting rod) 3, and the end 3A of the crossbar 3 is carried by the bus bar 1 as shown in FIG. 1, or arranged on the side bus bar 30 as shown in FIG. 4 for electrical connection.

As described above, therefore, a copper sulfate ($CuSO_4$) film or the like is produced at the electric contact between the crossbar 3 and the bus bar 10 or the side bus bar 30, thereby increasing contact resistance.

The crossbar 3 usually comprises a copper rod having a circular or rectangular cross-section. In the invention, as shown in FIG. 4, at least the end 3A of the crossbar 3, particularly the lower surface of the end 3A is gold (Au)-plated 13. It is needless to mention that gold plating should preferably be applied on a nickel (Ni)-plated primer. According to the results of research and experiments, achievement of a durability of about a year requires a thickness of about 5 $\mu$m.

By the use of the configuration as described above, adhesion of a copper sulfate ($CuSO_4$) film to the gold-plated surface of the end 3A of the crossbar 3 was inhibited and contact resistance was remarkably reduced from the conventional observation at the electric contact between the crossbar 3 and bus bar 10 or the side bus bar 30. The copper sulfate ($CuSO_4$) film adhering to the gold-plated surface of the end of the crossbar, though in a slight amount, could be easily removed by water rinsing, thereby providing a remarkable advantage for maintenance of the apparatus.

Embodiment 4

In electrolytic copper refining, as described above, the auricle 1A of the prescribed anode 1 is carried on the bus bar 10 as shown in FIG. 1, or arranged on the side bus bar 30 as shown in FIG. 4 for electric connection.

As a result, as described above, a copper sulfate ($CuSO_4$) film or the like is produced at the electric contact between the anode 1 and the bus bar 10 or the side bus bar 30, thereby causing an increase in contact resistance.

In the invention, as shown in FIG. 4, the auricle 1A of the anode in electric contact with the side bus bar 30, or the auricle 1A of the anode 1 in electric contact with the convex portion 12 of the bus bar 10 in FIG. 1, particularly the lower surface of the auricle 1A is gold (Au)-plated 13. Gold plating may of course be applied on a primer provided by nickel (Ni) plating. The results of research and experiments carried out by the present inventors suggest that is suffices to achieve a thickness of about 0.1 $\mu$m.

By the use of the configuration as described above, adhesion of a copper sulfate ($CuSO_4$) film to the gold-plated surface of the auricle 1A of the anode 1 was inhibited and contact resistance was remarkably reduced from the conventional one at the electric contact between the anode 1 and the bus bar 10 or the side bus bar 30. The copper sulfate ($CuSO_4$) film adhering to the gold-plated surface of the auricle of the anode 1, though slight in amount, could be easily removed by water rinsing, thereby providing a remarkable advantage for maintenance of the apparatus.

According to the structure of the electric contact of the electrolytic cell of the invention, as described above, the electric contact of the electrolytic cell is gold-plated.

It is therefore possible to inhibit an increase in contact resistance at the electric contact, apply electrolytic refining always at a high efficiency, and simultaneously, easily remove substances, such as copper sulfate ($CuSO_4$), produced at the electric contact of the electrolytic cell, thus providing advantages such as easy maintenance and management of the electric contact.

We claim:

1. A structure of an electric contact of an electrolytic cell, wherein an elongated conductive member is provided as a bus bar on a wall of an electrolytic cell for feeding current to anodes and cathodes arranged in the electrolytic cell; said conductive member forms a convex portion in parallel with the longitudinal direction on the upper surface of an elongated plate member forming a base; and at least the upper surface of said convex portion is totally or partially gold-plated in the longitudinal direction.

2. An apparatus for electrolytic copper refining comprising the structure of an electric contact of an electrolytic cell according to claim 1.

3. The apparatus for electrolytic copper refining according to claim 2, wherein said gold plating is applied after conducting nickel primer plating.

4. A structure of an electric contact of an electrolytic cell, wherein side bus bars and connecting conductors for electrically connecting the individual bus bars are provided along the side wall of electrolytic cells for electrically connecting neighboring electrolytic cells; at electric contacts between said side bus bars and said connecting conductors, any of the contact surfaces of at least any one of them is gold-plated; and said bus bars and said connecting conductors are secured.

5. An apparatus for electrolytic copper refining comprising the structure of an electric contact of an electrolytic cell according to claim 4.

6. The apparatus for electrolytic copper refining according to claim 5, wherein said gold plating is applied after conducting nickel primer plating.

7. A structure of an electric contact of an electrolytic cell according to claim 4, wherein said gold plating is applied after conducting nickel primer plating.

8. A structure of an electric contact of an electrolytic cell, wherein a crossbar is provided for suspending an electrode arranged in the electrolytic cell therefrom and for electrically connecting a bus bar or a side bus bar and the electrode; and at least the ends of the crossbar which come into electrical contact with the bus bar or the side bus bar are gold-plated.

9. An apparatus for electrolytic copper refining comprising the structure of an electric contact of an electrolytic cell according to claim 8.

10. The apparatus for electrolytic copper refining according to claim 9, wherein said gold plating is applied after conducting nickel primer plating.

11. A structure of an electric contact of an electrolytic cell according to claim 8, wherein said gold plating is applied after conducting nickel primer plating.

12. A structure of an electric contact of an electrolytic cell, wherein a bus bar or a side bus bar is provided on a wall of an electrolytic cell for feeding current to anodes arranged in the electrolytic cell; and each of said anodes is gold-plated at least at a portion in electrical contact with said bus bar or said side bus bar.

13. An apparatus for electrolytic copper refining comprising the structure of an electric contact of an electrolytic cell according to claim 12.

14. The apparatus for electrolytic copper refining according to claim 13, wherein said gold plating is applied after conducting nickel primer plating.

15. A structure of an electric contact of an electrolytic cell according to claim 12, wherein said gold plating is applied after conducting nickel primer plating.

16. A structure of an electric contact of an electrolytic cell according to claim 1, wherein said gold plating is applied after conducting nickel primer plating.

17. An apparatus for electrolytic copper refining comprising the structure of an electric contact of an electrolytic cell according to claim 16.

* * * * *